US007533855B2

(12) United States Patent
Marland

(10) Patent No.: US 7,533,855 B2
(45) Date of Patent: May 19, 2009

(54) CANTILEVER BAG HOLDER

(75) Inventor: Scott Kenneth Marland, Bountiful, UT (US)

(73) Assignee: Scott Marland, Bountiful, UT (US)

( * ) Notice: Subject to any disclaimer, the term of this patent is extended or adjusted under 35 U.S.C. 154(b) by 0 days.

(21) Appl. No.: 11/197,865

(22) Filed: Aug. 5, 2005

(65) Prior Publication Data

US 2006/0081737 A1 Apr. 20, 2006

Related U.S. Application Data

(60) Provisional application No. 60/607,525, filed on Sep. 7, 2004.

(51) Int. Cl.
*B65B 67/04* (2006.01)

(52) U.S. Cl. ..... 248/100; 248/95; 383/22

(58) Field of Classification Search ..... 383/23, 383/24, 13; 248/95, 100
See application file for complete search history.

(56) References Cited

U.S. PATENT DOCUMENTS 1,392,716 A * 10/1921 Spraggins ..... 248/99
2,048,300 A * 7/1936 Showers ..... 242/407
2,057,836 A * 10/1936 Leonardson ..... 248/99
2,144,885 A * 1/1939 MacFadden ..... 248/222.12
2,253,444 A * 8/1941 Muller ..... 248/75
2,392,034 A * 1/1946 Ellis et al. ..... 383/96
2,578,391 A * 12/1951 Behr ..... 294/169
2,643,046 A * 6/1953 Humphreys ..... 248/110
2,716,516 A * 8/1955 Weston ..... 294/165
2,757,699 A * 8/1956 Fancher et al. ..... 383/13
2,900,156 A * 8/1959 Styers ..... 248/99
2,917,260 A * 12/1959 Barber et al. ..... 248/99
3,002,240 A * 10/1961 Laguerre ..... 24/30.5 L
3,215,385 A * 11/1965 Rockland ..... 248/317
4,699,613 A * 10/1987 Donawick et al. ..... 604/80
5,060,809 A * 10/1991 Bayes et al. ..... 211/59.1
5,360,189 A 11/1994 Hart
5,375,799 A * 12/1994 Rhodes ..... 248/95
5,540,501 A * 7/1996 Franco ..... 383/13
5,582,377 A * 12/1996 Quesada ..... 248/229.12
5,826,838 A 10/1998 Forbes
5,921,601 A * 7/1999 Buckles ..... 294/142
6,095,173 A * 8/2000 Perry ..... 141/392
6,267,334 B1 7/2001 Siu
6,276,645 B1 8/2001 Chang
6,296,212 B1 10/2001 Monahan
6,325,341 B1 12/2001 Brown
6,334,593 B2 1/2002 Inoue
6,398,410 B1 * 6/2002 Guerra ..... 383/24
6,418,988 B1 * 7/2002 Palumbo et al. ..... 141/392
6,450,461 B1 9/2002 Lohmann
6,517,033 B2 2/2003 Russel
6,648,386 B2 11/2003 Rheinhardt
6,691,959 B1 * 2/2004 Dancy ..... 248/100

(Continued)

*Primary Examiner*—J. Allen Shriver, II
*Assistant Examiner*—Bradley H Duckworth

(57) ABSTRACT

This invention provides a cantilever bag holder that provides an alternative to conventional garbage cans for holding a garbage collection bag, or similar, for use in locations where conventional garbage cans are impractical or undesirable. This invention provides a rigid structure that is secured around a support, such as a tree, post, nail or hook. One aspect of the invention includes a convenient notch for holding a garbage bag (or similar) in a convenient position for use. This invention has practical use in applications such as camping, picnics, yard work and construction.

7 Claims, 5 Drawing Sheets

U.S. PATENT DOCUMENTS 6,705,575 B1 3/2004 Hoy
6,736,358 B2 5/2004 Johnson
6,843,453 B1 1/2005 Rogers
6,863,249 B1 * 3/2005 Alvord ..... 248/95
2002/0145086 A1 * 10/2002 Alvarado et al. ..... 248/95

* cited by examiner

CANTILEVER BAG HOLDER

RELATED APPLICATION

This application claims priority to commonly owned application Ser. No. 60/607,525 filed Sep. 7, 2004, which is incorporated herein by reference.

FIELD OF INVENTION

This invention relates to the field of supporting and holding bags. In particular this invention relates to a method to support a bag from many different structures in a way that makes it easily accessible, yet keeps it upright and prevents spilling.

BACKGROUND OF THE INVENTION

The use of garbage cans can be cumbersome and impractical in many circumstances. Examples of these circumstances include camping, picnicking, backyard barbeques and confined locations (i.e. remodeling a bathroom with a narrow doorway prevents the use of a large trash can). Other circumstances, such as raking leaves or grass, where one garbage can is insufficient to contain all refuse, makes the use of bags alone (that is, without any garbage can for support) much more attractive.

SUMMARY OF THE INVENTION

One embodiment of the present invention includes a fixture that supports a bag in a usable position from any of many different structures. The fixture has different methods of attachment to a structure. One method is as a cantilever that is angled outward from a structure. A cord is wrapped around the support and fixed back to the fixture. Spikes (points) on the bottom of the fixture then prevent it from slipping down. The weight of the bag provides a downward force on the top end of the fixture that causes a moment and force on the bottom of the fixture that prevents it from slipping on the support. This provides a stable support for the bag.

A second method for support uses two holes on the top of the fixture. The cord is threaded up through one hole on the top of the fixture, then back through the other top hole on the opposing side and fixed to the fixture. The loop in the cord, between the two top holes, is then hung over any protrusion, such as a nail or hook in a wall or small branch of a tree.

In each of the above scenarios the bag is then knotted (e.g. an over hand knot tied by grasping a "bite" from the perimeter of the open end of the bag) or gathered and then is slipped into the notch in the top of the fixture.

This summary is not a replacement for the claims, but is rather meant to assist in understanding the claims. Other aspects and advantages of the present invention will become more fully apparent through the following description.

BRIEF DESCRIPTION OF THE DRAWINGS

To illustrate the manner in which the advantages and features of the invention are obtained, a more particular description of the invention will be given with reference to the attached drawings. These drawings only illustrate selected aspects of the invention and thus do not fully determine the invention's scope. In the drawings.

DETAILED DESCRIPTION

In describing the invention, the meaning of several important terms is clarified, so the claims must be read with careful attention to these clarifications. Specific examples are given to illustrate aspects of the invention, but those of skill in the relevant art(s) will understand that other examples may also fall within the meaning of the terms used, and hence within the scope of one or more claims. Important terms may be defined, either explicitly or implicitly, here in the Detailed Description and/or elsewhere in the application file.

In particular, an "embodiment" of the invention may be a device (e.g., fixture alone, fixture with cord), system (e.g., fixture, cord, bag, and support such as tree or hook), an article of manufacture (e.g., fixture), or a method (e.g., using fixture in cantilever position, using fixture in hanging position).

Figure 1:
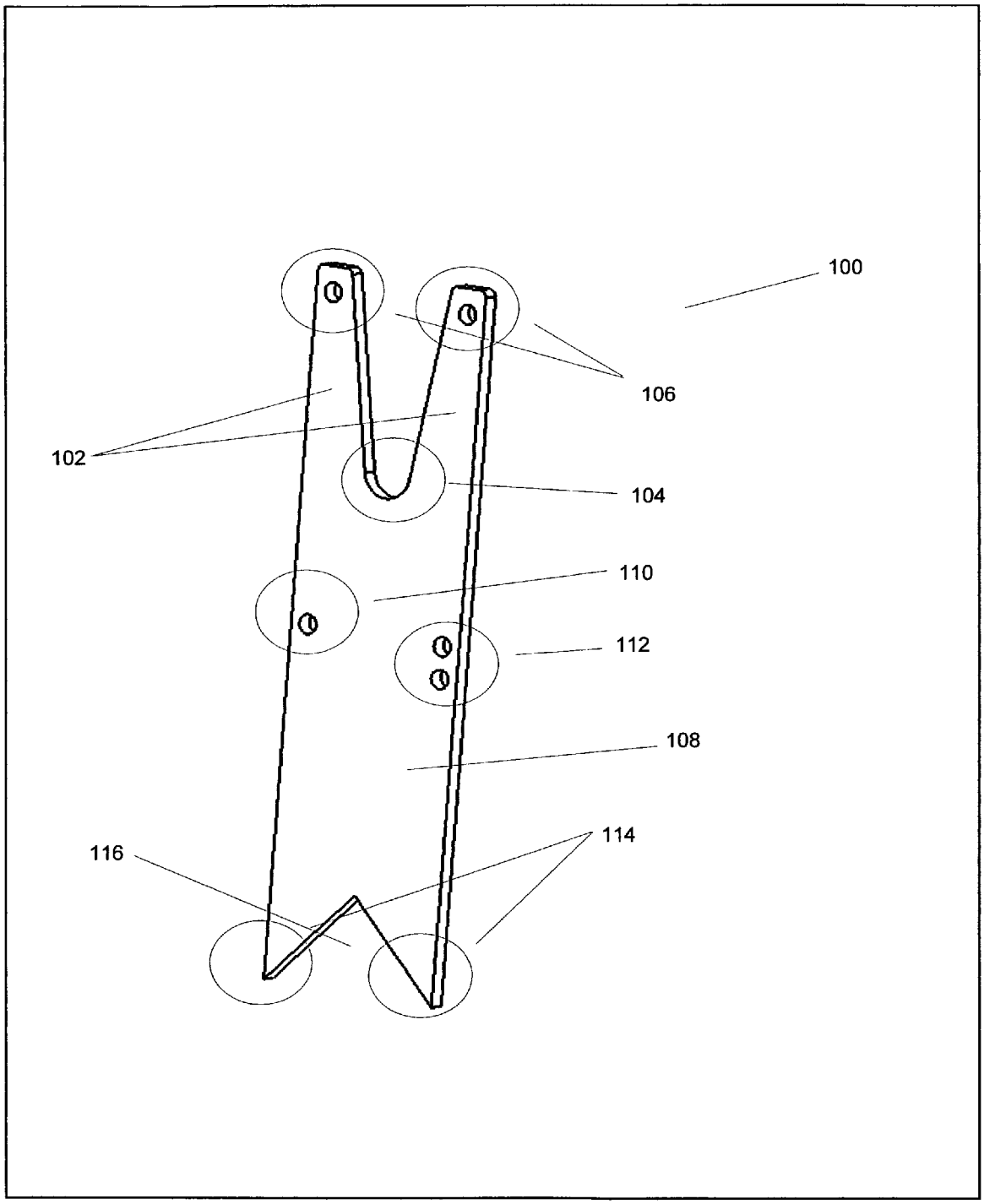
FIG. 1 is a form perspective view of a fixture according to one embodiment of the present invention.

FIG. 1 shows one embodiment of a fixture 100 according to the present invention. The fixture shown has two prongs 102 which form a notch 104. Each prong has a hanging hole 106. The prongs extend from a body 108 of the fixture 100. The body has a fixed cord attachment hole 110, and two tying holes 112. Two spikes 114 extend from the body generally opposite the notch 104. The spikes define a separating gap 116.

The fixture 100 may be constructed of metal, plastic, wood, or from any other suitable material or multiple materials. Such materials are considered "rigid" even if they bend or break under pressure, provided they have enough strength to operate reliably most of the time under the expected conditions.

The shape of a fixture according to the invention may depart in various ways from the embodiment shown in FIG. 1. For instance, it may have a single spike, multiple spikes (similar to 114 in FIG. 1) or many spikes such as a serrated edge. The spike area may also be coated with a substance such as rubber, plastic or similar to increase friction with the support. The notch (104 in FIG. 1) may be of different shape such as longer, shorter or equal to that shown. The notch may also be wider, equal or narrower to that shown and the angle may be larger smaller or equal to that shown. There may also be multiple notches of the variations mentioned.

In one embodiment, the fixture is approximately 1½ inches wide (from the edge near hole 110 to the edge near holes 112), approximately 5½ inches long (from spike 114 tip to prong 102 tip), and approximately ⅛ inch thick. However, it will be appreciated that inventive fixtures of various sizes may be used, both smaller ones and larger ones. Likewise, although FIG. 1 necessarily shows relative proportions for the various features of the illustrated fixture, it will be understood that these proportions may vary in other embodiments. To give just a few examples of possible variations, the holes 110 and/or 112 may be closer to one end or the other than shown; the holes may be larger of smaller or equal to that shown; the spike gap 116 may be as deep or deeper or less deep than the bag notch 104.

As to terminology, it will be noted that the fixture alone, as opposed to the fixture with a cord, is referred to in the discussion of FIG. 1 as the "fixture". Unless clearly indicated otherwise by context or for operability, when the claims refer to a "fixture" a cord is not necessarily present. However, it should be understood that when operation of the fixture is being discussed, a "cord" (cord, rope, string, thread, wire, line, chain, strap, band or the like) will be present, as shown for example by the cord 200 in FIGS. 2 and 3, even if the discussion only directly mentions the fixture.

Figure 2:
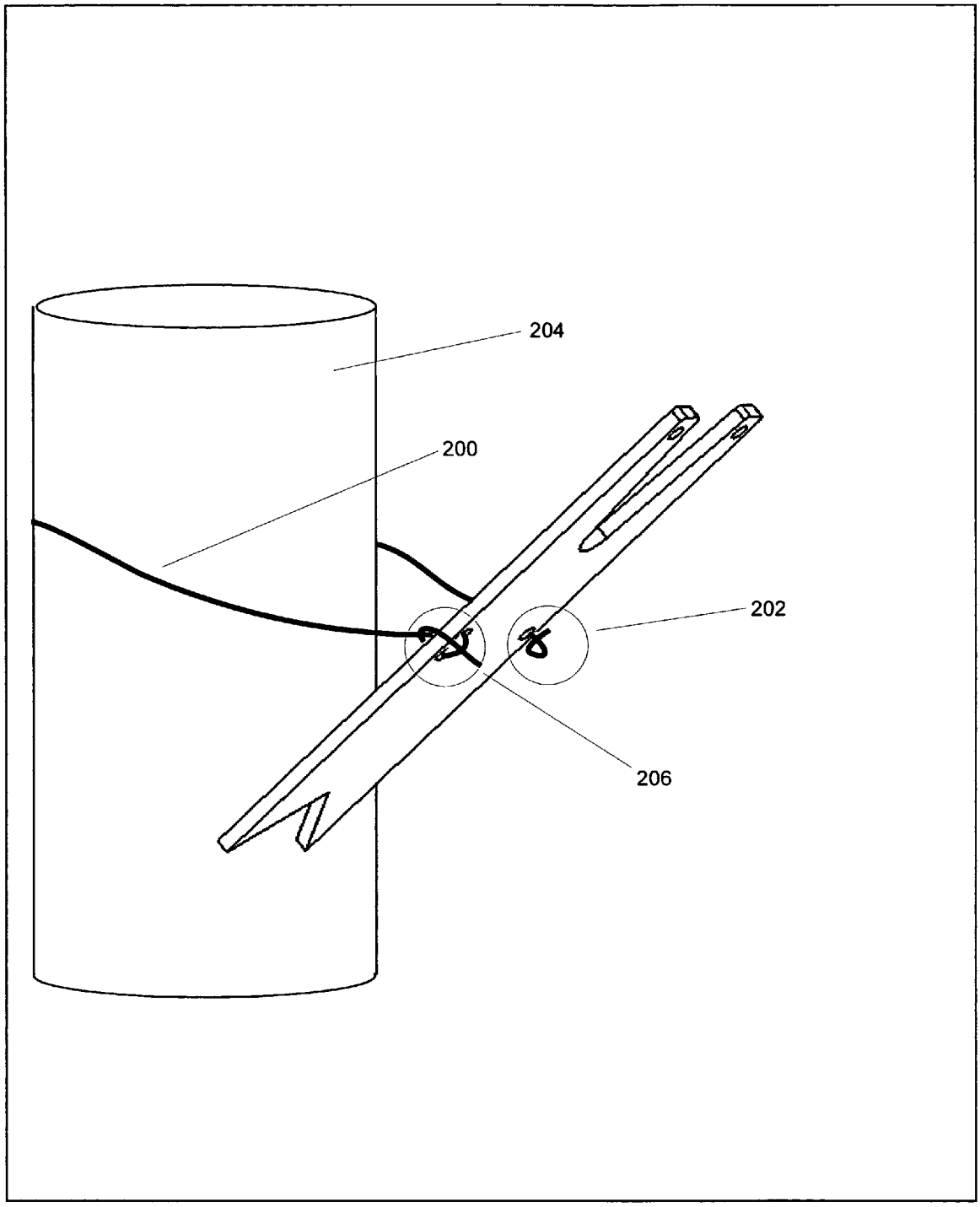
FIG. 2 is a perspective view of one embodiment of the invention's fixture in a cantilever usage.
Figure 3:
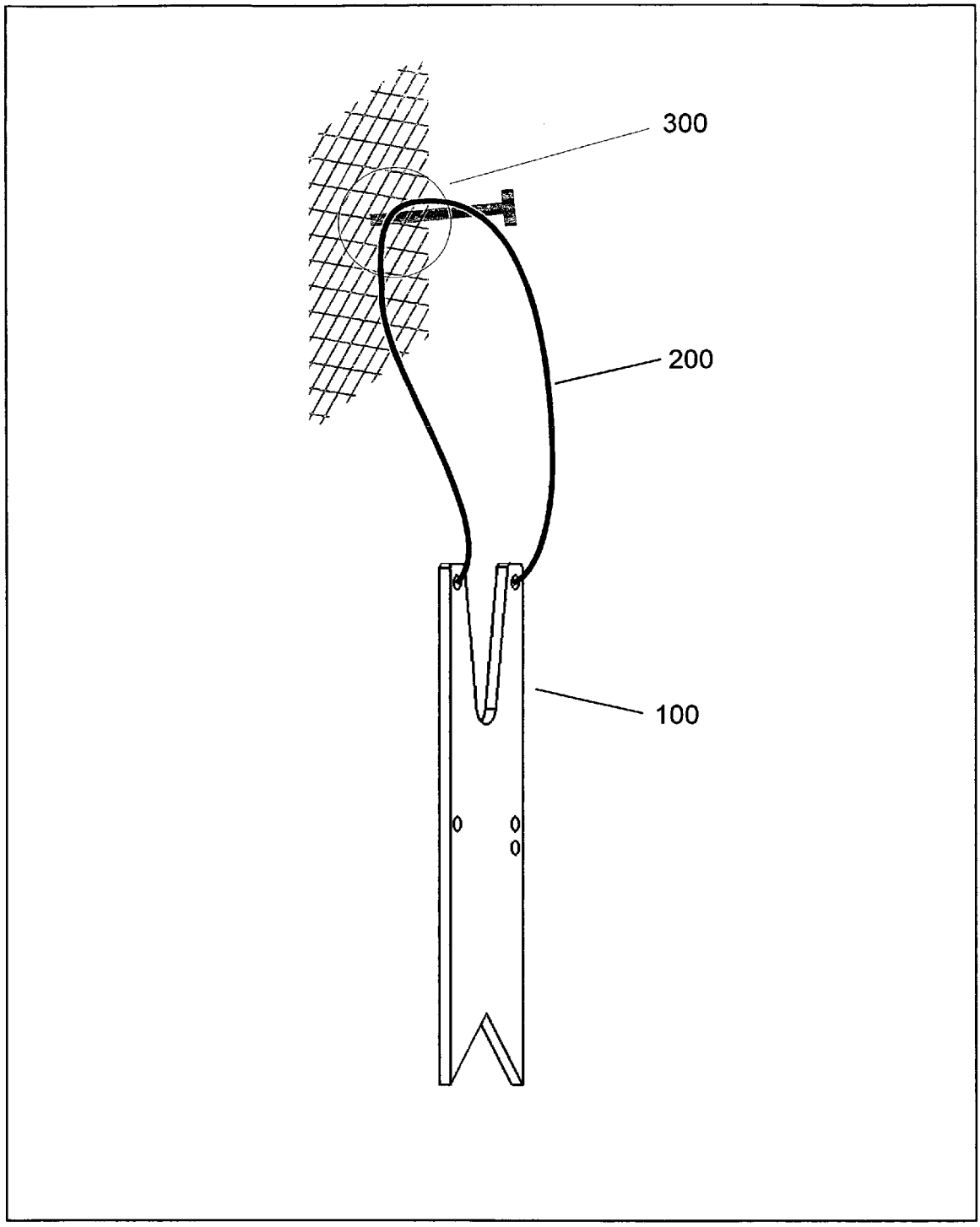
FIG. 3 is a perspective view of one embodiment of the invention's fixture in a hanging usage.

In operation, hanging holes 106 can be used for attachment of a cord so that the fixture may be hung from a hook, nail, or the like by a cord, string or the like (FIG. 3). The notch 104 is where a knotted bag is hooked or wedged so that it will hang. The fixed cord attachment hole 110 is for a fixed end of the cord, e.g., an end 202 (FIG. 2) that is knotted to prevent that end from passing through the hole 110. The cord is knotted or tied through or around this hole so that it remains attached. The tying holes 112 are for tying the cord after it passes around a support structure 204. The spikes 114 are to grip or dig into the support structure to prevent the bag holder from sliding downwards.

As shown in FIG. 2, the support structure 204 can be nearly anything that the cord can encircle. Some examples include wood 4×4s or trees, but many other support structures can also be used. Indeed, with suitably blunt spikes, the support structure could be a person or a pack animal.

The cord 200 is a flexible item of sufficient strength that can be secured to the fixed cord attachment hole and the tying holes (206), and that can encircle the support structure (FIG. 2) or hang from a protrusion 300 (FIG. 3).

Figure 4:
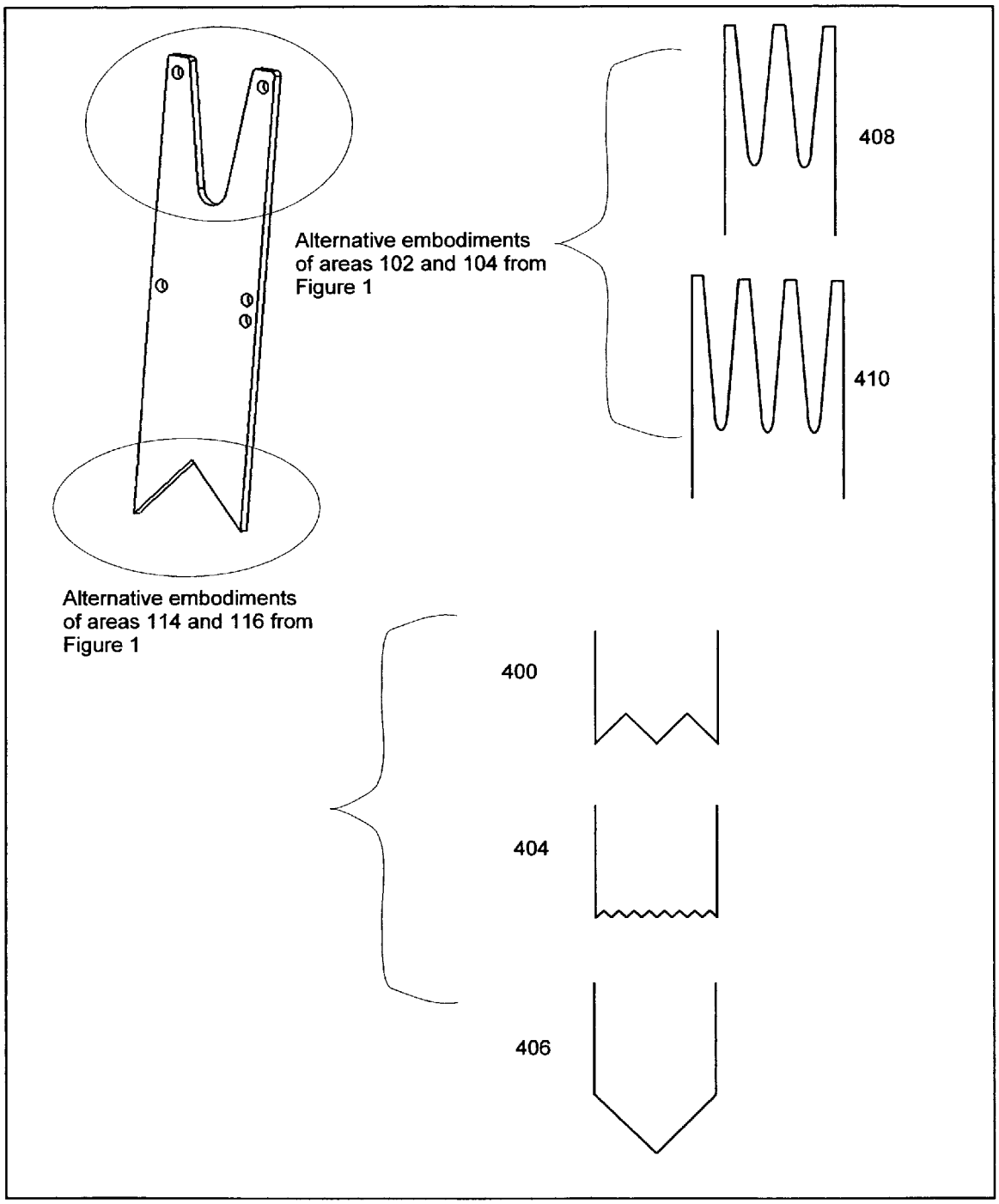
FIG. 4 shows several alternate embodiments of the spikes on the bottom end of the fixture and multiple bag notches at the top of the fixture.

FIG. 4 shows several alternate embodiments of the areas 114 and 116 (FIG. 1). 400 shows multiple spikes, three in this instance, but more than 3 constitute a similar alternate embodiment. 404 shows a serrated edge and 406 shows a single spike. 408 and 410 show multiple bag notches, two and three in these instances, but more than 3 constitute a similar embodiment.

Figure 5:
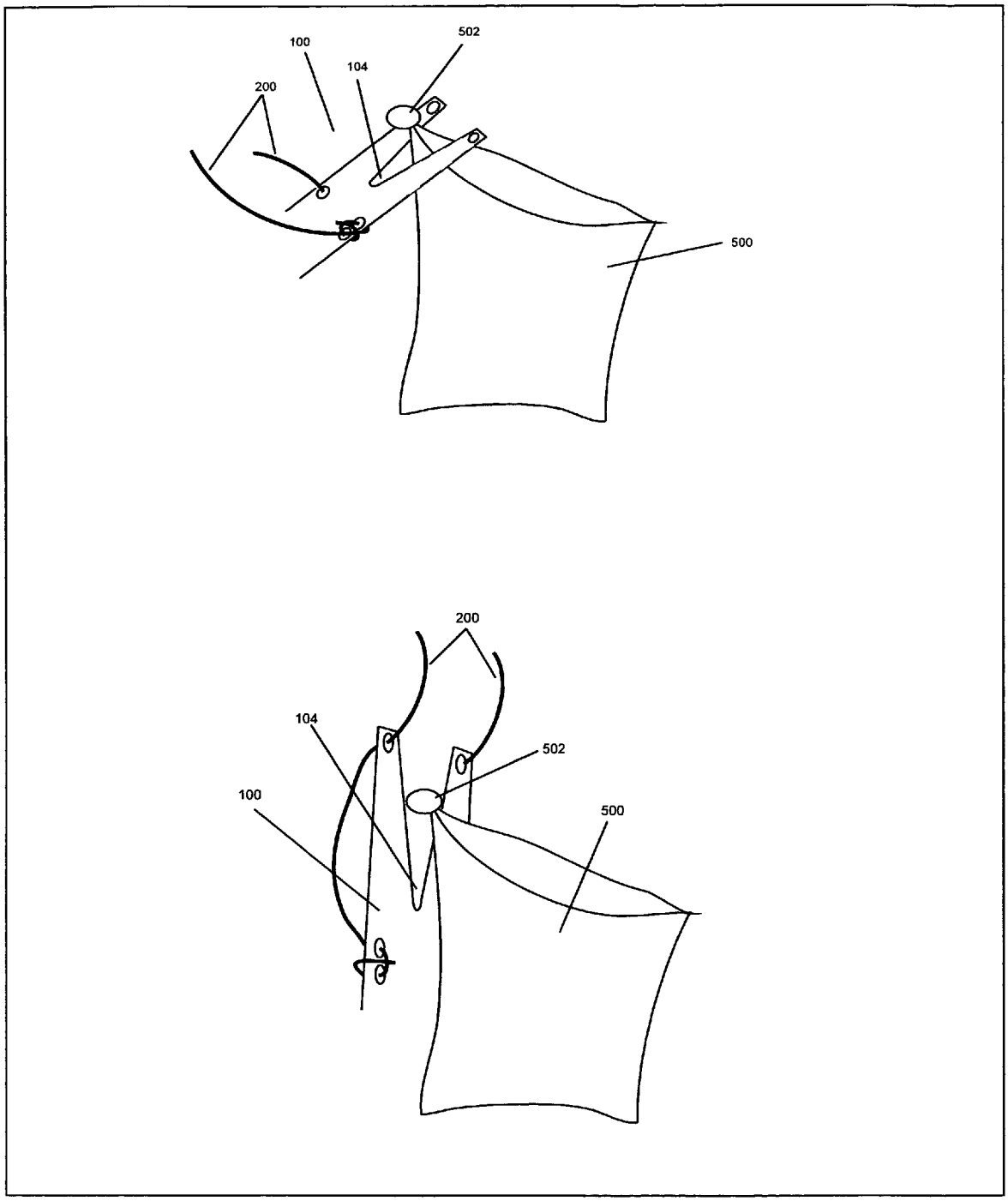
FIG. 5 shows two embodiments with a bag in use

FIG. 5 shows two uses of the invention where the bag 500 has an obstructive feature (502), such as a knot (or material that is sufficiently hard so as not to deform in use) in notch 104. The two sketches (top and bottom) are for clarification of a use of the fixture focusing on bag 500, obstructive feature 502 and notch 104 while showing other parts of the fixture (incomplete) for reference.

Although particular embodiments of the present invention are expressly illustrated and described individually herein, it will be appreciated that discussion of one type of embodiment also generally extends to other embodiment types. For instance, the description of the methods illustrated in FIGS. 2 and 3 also helps describe the fixtures shown in the figures, and systems containing fixtures, and vice versa. All claims as filed are part of the specification and thus help describe the invention, and repeated claim language may be inserted outside the claims as needed.

As used herein, terms such as "a" and "the" and designations such as "hanging", and "spike", are inclusive of one or more of the indicated item or step. In particular, in the claims a reference to an item generally means at least one such item is present and a reference to a step means at least one instance of the step is performed.

The invention may be embodied in other specific forms without departing from its essential characteristics. The described embodiments are to be considered in all respects only as illustrative and not restrictive. Headings are for convenience only. The scope of the invention is, therefore, indicated by the appended claims rather than by the foregoing description. All changes which come within the meaning and range of equivalency of the claims are to be embraced within their scope to the full extent permitted by law.

The invention claimed is:

1. A cantilever bag holder in combination with a bag having a knot formed along the edge of an open end of the bag and a cord, the bag holder comprising a rigid body with a first end having at least one spike for contacting a support surface, a second end with at least one notch for receiving the knot of the bag, the rigid body further comprising at least one hole between the first and second ends for receiving the cord, the cord being used to attach the bag holder to a support structure, wherein in use the bag holder is attached to a support structure by the cord received in the at least one hole of the bag holder and the bag holder is positioned with the spike contacting the support structure such that the second end with the bag notch faces upwards and away from the first end, with the bag notch receiving the knot of the bag to retain the bag in the bag notch.

2. The combination of claim 1, wherein the at least one spike includes multiple spikes.

3. The combination of claim 1, wherein the at least one spike includes an attached friction-increasing material.

4. The combination of claim 1, wherein the at least one notch includes two prongs, and at least one of the prongs has a hole.

5. The combination of claim 1, wherein the at least one notch includes prongs that define multiple notches.

6. The combination of claim 1, wherein the rigid body has at least two holes between the first and second ends for securing the cord to the rigid body between the first and second ends.

7. The combination of claim 1, wherein the rigid body has at least one hole between the first and second ends and at least one cord notch between the first and second ends for securing the cord to the rigid body between the first and second ends.

* * * * *